US008917898B2

(12) United States Patent
Emonts et al.

(10) Patent No.: US 8,917,898 B2
(45) Date of Patent: Dec. 23, 2014

(54) ACOUSTIC LOUDSPEAKER

(75) Inventors: Daniel Emonts, Altorf (FR); Arnaud Cazes Bouchet, Balbigny (FR)

(73) Assignee: Focal Jmlab, La Talaudiere (FR)

( * ) Notice: Subject to any disclaimer, the term of this patent is extended or adjusted under 35 U.S.C. 154(b) by 19 days.

(21) Appl. No.: 13/701,307

(22) PCT Filed: Jun. 3, 2011

(86) PCT No.: PCT/FR2011/000330

§ 371 (c)(1),
(2), (4) Date: Feb. 26, 2013

(87) PCT Pub. No.: WO2011/151546

PCT Pub. Date: Dec. 8, 2011

(65) Prior Publication Data

US 2013/0148841 A1 Jun. 13, 2013

(30) Foreign Application Priority Data

Jun. 4, 2010 (FR) ..... 10 54386

(51) Int. Cl.
*H04R 9/04* (2006.01)
*H04R 9/06* (2006.01)
*H04R 3/00* (2006.01)

(52) U.S. Cl.
CPC .. *H04R 9/06* (2013.01); *H04R 9/04* (2013.01); *H04R 2209/043* (2013.01); *H04R 3/002* (2013.01)
USPC ..... 381/401; 381/409; 381/410

(58) Field of Classification Search
CPC .. H04R 3/002; H04R 2209/041; H04R 9/045; H04R 9/046
USPC ..... 381/400, 401, 409, 410, 413, 414
See application file for complete search history.

(56) References Cited

U.S. PATENT DOCUMENTS

| | | | | | |
|---|---|---|---|---|---|
| 1,935,404 | A | * | 11/1933 | Joachim | 335/231 |
| 3,766,334 | A | * | 10/1973 | Burke | 381/117 |
| 3,838,216 | A | * | 9/1974 | Watkins | 381/117 |
| 4,160,133 | A | * | 7/1979 | Wiik | 381/401 |
| 4,335,274 | A | * | 6/1982 | Ayers | 381/96 |
| 4,504,704 | A | * | 3/1985 | Ohyaba et al. | 381/332 |
| 5,828,767 | A | * | 10/1998 | Button | 381/401 |

(Continued)

FOREIGN PATENT DOCUMENTS

| | | | |
|---|---|---|---|
| DE | 19528904 | C1 | 4/1997 |
| GB | 2010639 | A | 6/1979 |
| JP | 54076132 | | 6/1979 |

OTHER PUBLICATIONS

European Patent Office, International Search Report for corresponding International Application No. PCT/FR2011/000330 dated Aug. 18, 2011 in the French and English Languages (4 pgs).

*Primary Examiner* — Curtis Kuntz
*Assistant Examiner* — Joshua A Kaufman
(74) *Attorney, Agent, or Firm* — Harris Beach PLLC

(57) ABSTRACT

The invention relates to an acoustic loudspeaker which includes a magnetic field source. A mobile apparatus includes a diaphragm and a first winding capable of allowing passage of an electrical current representing the sound signal to be generated and of interacting with the magnetic field. The acoustic loudspeaker includes a second winding, both terminals of which are connected by a resistive component. Both terminals of the second winding are electrically isolated from the terminals of the first winding.

4 Claims, 2 Drawing Sheets

(56) References Cited

U.S. PATENT DOCUMENTS

| | | | | |
|---|---|---|---|---|
| 6,359,996 | B1 * | 3/2002 | Ohashi | 381/401 |
| 6,587,571 | B1 * | 7/2003 | Fujihira et al. | 381/407 |
| 6,901,150 | B1 * | 5/2005 | Anciant | 381/401 |
| 6,904,158 | B1 * | 6/2005 | Ohashi | 381/401 |
| 7,940,950 | B2 * | 5/2011 | Shim | 381/393 |
| 2004/0086149 | A1 * | 5/2004 | Johannsen et al. | 381/412 |
| 2005/0031151 | A1 * | 2/2005 | Melillo | 381/401 |
| 2006/0039578 | A1 * | 2/2006 | Stiles et al. | 381/400 |
| 2006/0188120 | A1 * | 8/2006 | Fisher | 381/338 |
| 2007/0183620 | A1 * | 8/2007 | Stiles et al. | 381/401 |
| 2008/0025551 | A1 * | 1/2008 | Wehner | 381/401 |

* cited by examiner

ACOUSTIC LOUDSPEAKER

CROSS-REFERENCE TO RELATED APPLICATIONS

This application is a national stage application under 35 U.S.C. §371 of PCT Application No. PCT/FR2011/000330, filed Jun. 3, 2011, which claims priority to and the benefit of French Application No. 1054386 filed on Jun. 4, 2010, which are incorporated herein by reference in its entirety.

BACKGROUND

The present disclosure relates to the field of acoustic loudspeakers. It more specifically aims at a loudspeaker equipped with elements enabling it to ensure a setting in the low frequency range, and more specifically in the bass sound range.

PRIOR ART

Generally, it is known that the reproduction of bass sounds, that is, sounds located in the 20-250 Hertz band, is a major element in the appraisal of the quality of an audio system. Indeed, when a recording has been made correctly by including enough richness in the low portion of the spectrum, the sound quality depends, on the one hand, on the capacity of an amplifier to properly restore such bass sounds, and also, on the other hand, on the loudspeaker performance which is itself, as concerns bass sounds, dependent on the room containing the loudspeaker. Thus, the dimension and the geometry of the room may have an influence since, at the considered bass frequencies, the quantity of air displaced by the loudspeaker membrane is significant. Similarly, at the corresponding frequencies, the wavelengths are such that reflection phenomena may cause the occurrence of wave nodes and anti-nodes whereby, according to where the listener is placed, the sound quality may be very variable.

It is thus known that adjustments may be necessary to provide an optimal sound quality, such adjustments having to be made in the room where the loudspeaker is installed.

Different techniques have already been provided to ensure this type of setting, without however being really satisfactory. Mechanical-type solutions have thus already been provided, which comprise modifying the port parameters on "bass-reflex"-type loads, either by modifying the port length, or by plugging it with foam. Such a solution modifies the resonance frequency of the port. This translates as a level increase at the resonance frequency, but also as an attenuation of sounds of lower frequency, with a sensation of imbalance of the bass response.

Electronic solutions have already been provided by filtering the signal transmitted to the loudspeaker. Passive filterings lower the amplitude without really providing solutions over a sufficiently wide frequency band. Active-type filterings are not satisfactory either since a possible amplitude gain generally causes alterations of the signal by the passing through a great number of electronic correction circuits, which results in losses of information, and thus of acoustic transparency.

The Applicant has provided another solution, which comprises using as a magnetic field source, instead of a magnet (which generates a constant field), a device that to can be considered as an electromagnet. Although this solution is satisfactory from an acoustic viewpoint, it is however complex and expensive to implement, which limits it to very top-end installations.

A specific loudspeaker has been described in document DE 19528904. This loudspeaker comprises a second coil assembled on the moving part and in the magnetic field of the loudspeaker magnet. This coil is shorted, and enables to protect the loudspeaker against overcurrents and excessive vibrations.

The problem that the invention aims at solving thus is to allow a setting in the bass sound frequency band, without generating significant modifications on neighboring frequencies, and without requiring a complex or expensive installation either.

SUMMARY OF THE INVENTION

The invention thus relates to an acoustic loudspeaker which comprises:

- a constant magnetic field source;
- a moving part comprising a membrane, a coil capable of conducting an electric current representative of the sound signal to be generated, and of interacting with this constant magnetic field, and a second coil also located in the magnetic field.

According to the invention, this loudspeaker is characterized in that the two terminals of the second coil are connected by an essentially resistive component, selected from a set of resistive elements of different resistance values, due to means for connecting one of these elements across the second coil. Such means may be particularly varied, and may for example be a set of jumpers or of multi-position knobs which enable to connect the most appropriate resistance.

In other words, the loudspeaker is equipped with a coil in short-circuit or in closed circuit on a resistor, which moves in the magnetic field like the main coil, and where induced currents thus appear, which dissipate by Joule effect in the resistive element connected thereacross. Thereby, the damping factor (or Qms) of the loudspeaker is set to provide the best possible coupling between the volume of the listening room and the loudspeaker volume. Thus, a back electromotive force which tends to prevent the coil from moving in the pole gap appears in the complementary coil, which is in practice associated with the main coil conducting the control current.

In practice, the moving part should not be made heavier by the presence of this complementary coil, and a good compromise can be found when this second coil has a volume of conductive material substantially identical to that of the main coil.

"Substantially equal" volumes means that the difference between the two volumes is smaller by 20% than the smallest volume. However, the damping phenomenon may appear for complementary coils which have a volume quite different from that of the main volume, according to whether the inertia of the moving part or, conversely, the damping rate, is desired to be privileged.

Thus, in a preferred version, the use of wires of rectangular cross-section which enables to form a coil with less loss of space than a wire of cylindrical cross-section will be preferred, although it is more difficult to form.

In practice, the wires of the damping coil may be made of copper, that is, of the same material as the main coil, or even of another material than aluminum or the like. A compromise may be found between a weight decrease due to the use of a conductor of lower density than aluminum, and the resistance value of the conductor, depending on its resistivity and on its cross-section.

BRIEF DESCRIPTION OF THE DRAWINGS

The implementation of the invention as well as the resulting advantages will clearly appear from the description of the following embodiment in connection with the accompanying drawings, among which.

EMBODIMENTS OF THE INVENTION

Figure 1:
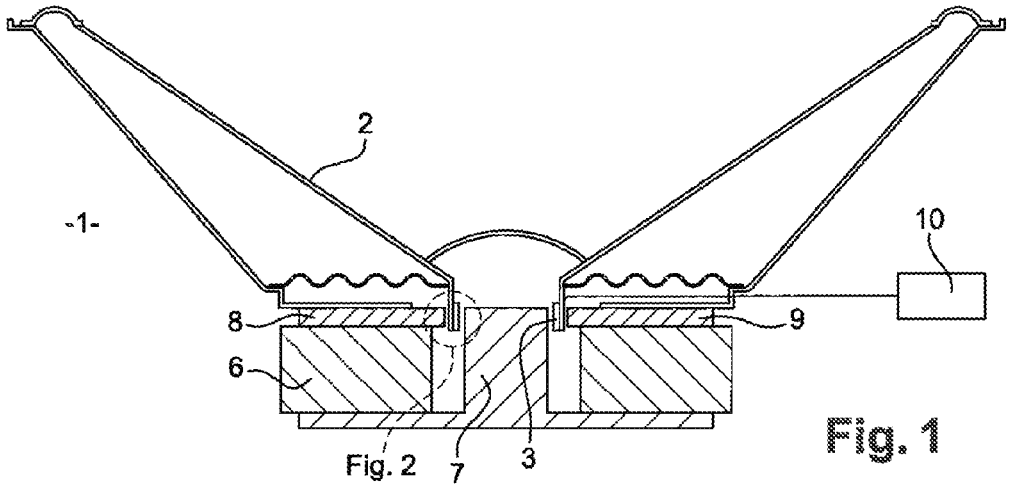
FIG. 1 is a cross-section view of a loudspeaker according to the invention.

As illustrated in FIG. 1, a loudspeaker 1 conventionally comprises a moving part, formed of a membrane 2 to which is associated a coil 3 connected to amplifier 10 delivering the electric signal representative of the acoustic wave to be generated.

Coil 3 moves inside of an area where a constant magnetic field is generated, said field being created by a field source which generally is a magnetized element 6, associated with polar parts 7, 8, 9, to confine the field lines at the level of coil 3 with a minimum pole gap.

According to the invention, the loudspeaker comprises a second coil which, in the shown form, covers the main coil to be submitted to the same magnetic field.

Figure 2:
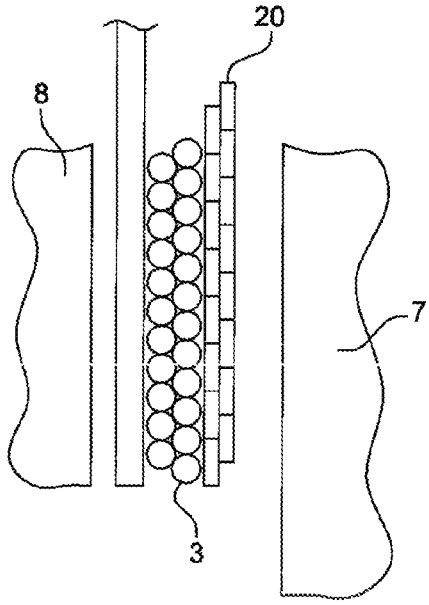
FIG. 2 is a cross-section view of a detail of FIG. 1.

As illustrated in FIG. 2, main coil 3 is formed by a winding of wires, typically made of copper, of round cross-section, while coil 20 used to modulate the damping factor is formed of a wire of rectangular cross-section. This layout enables to avoid too strong an increase of the pole gap while keeping as low a coil resistance as possible and a sufficient copper volume. However, the principle of the invention also works with the use of other types of wires, for example, having a cylindrical cross-section, or made of analog materials such as aluminum.

Figure 3:
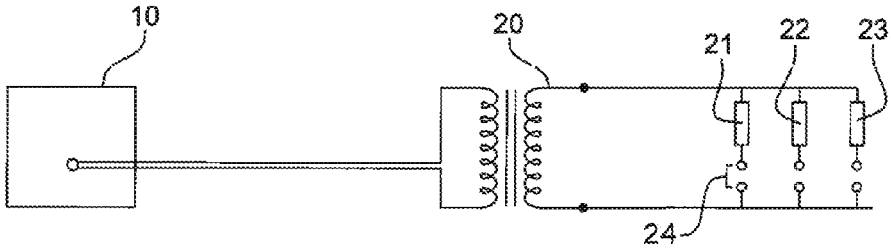
FIG. 3 is an electric diagram showing the setting capacity of the loudspeaker according to the invention.

As illustrated in FIG. 3, damping coil 20 may be connected to different resistive elements 21-23. One of these elements may be a resistive element of very low value to simulate a short-circuit in order to obtain the maximum damping. It may also be a resistive element of medium value which enables to limit the current and to be at an intermediate value of the mechanical overvoltage coefficient (Qms). This value is calculated on a case by case basis, to obtain an overvoltage coefficient value of intermediate level. In the end, this setting is performed in the listening room, according to the user's perceptions and to the reverberation level of this place. It may also be performed in factory, provided that the geometrical parameters of the room where the loudspeaker will be installed are known. The number of connectable resistive elements may vary according to the fineness of the setting which is desired to be performed. It is also possible for damping coil 20 to be left floating to avoid creating an electromagnetic force, in which case the damping coil does not create a back electromotive force so that the loudspeaker operates with its original parameters.

As already mentioned, this setting may occur in different ways without departing from the principle of the invention, be it with jumpers 24 such as illustrated in FIG. 3, or with a thumbwheel ensuring the connection of the appropriate resistor 21, 22, 23.

Figure 4:
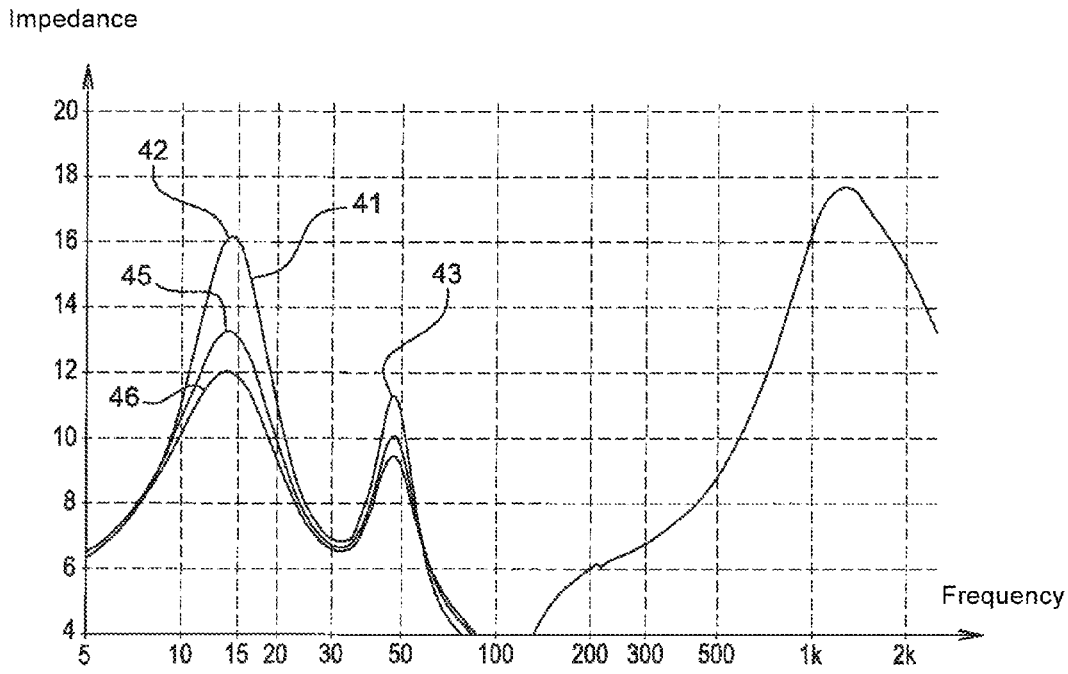
FIG. 4 is a curve showing the impedance of the loudspeaker for different setting values of the resistor connected across the second coil.

An embodiment is illustrated in FIG. 4, which shows the loudspeaker impedance seen by the amplifier in ordinates, and the frequency in abscissas, the bass sound area being privileged. Thus, curve 41 which has the strongest peaks, corresponds to an open circuit situation, a quasi-infinite resistance. The two peaks 42, 43 located close to 15 and 50 Hertz correspond to couplings between the loudspeaker and the port according to the enclosure volume and to the Thiele and Small parameters of the loudspeaker. Curve 46 corresponds to the position where the damping coil is almost shorted, that is, to the maximum setting position, for which the original mechanical damping factor (Qms) has been divided by more than 14, the sound level decrease between 50 and 100 Hz being −3 dB with respect to the initial level. Curve 45 corresponds to the intermediate current flow position in a resistor of 2.2 ohms which enables to decrease the sound level between 50 and 100 Hz by −1.5 dB, factor Qms being divided by 8.

The foregoing shows that the loudspeaker according to the invention has the advantage of being settable so as to adjust its mechanical quality factor, which has a very high resolution, including in the bass range, and this, with an easy-to-implement solution, which makes it applicable for a wide range of loudspeakers. Thus, the invention enables to adjust the response of the acoustic enclosure to the listening room.

The invention claimed is:

1. An acoustic loudspeaker comprising:

a magnetic field source;

a moving part comprising a membrane, a first coil capable of conducting an Electric current representative of the sound signal to be generated, and of interacting with said magnetic field and a second coil having two terminals, said second coil electrically isolated from said first coil;

a set of essentially resistive elements of different resistance values, and means for connecting one of said elements across the terminals of said second coil.

2. The loudspeaker of claim 1, wherein the second coil is formed from a wire of rectangular cross-section.

3. The loudspeaker of claim 1, wherein the second coil has a conductor material volume substantially equal to that of the coil conducting the current representative of the signal.

4. The loudspeaker of claim 1, wherein the means for connecting comprises one of a set of jumpers or of multi-position knobs.

* * * * *